US012590459B2

(12) United States Patent
Meinarts et al.

(10) Patent No.: US 12,590,459 B2
(45) Date of Patent: Mar. 31, 2026

(54) JOINT FOR WALL PANELS MADE OF CROSS LAMINATED TIMBER

(71) Applicant: CLT FACTORY, SIA, Talsi (LV)

(72) Inventors: Eriks Meinarts, Talsi (LV); Peter Frandsen, Talsi (LV)

( * ) Notice: Subject to any disclaimer, the term of this patent is extended or adjusted under 35 U.S.C. 154(b) by 190 days.

(21) Appl. No.: 18/695,822

(22) PCT Filed: Oct. 10, 2022

(86) PCT No.: PCT/LV2022/050010
§ 371 (c)(1),
(2) Date: Mar. 27, 2024

(87) PCT Pub. No.: WO2023/059174
PCT Pub. Date: Apr. 13, 2023

(65) Prior Publication Data

US 2024/0392564 A1 Nov. 28, 2024

(30) Foreign Application Priority Data

Oct. 8, 2021 (LV) ..... LVP2021000064

(51) Int. Cl.
*E04C 2/24* (2006.01)
*E04C 2/00* (2006.01)

(52) U.S. Cl.
CPC ..... *E04C 2/24* (2013.01); *E04C 2002/004* (2013.01)

(58) Field of Classification Search
CPC ..... E04C 2/24; E04C 2002/004; E04C 2/292; E04F 13/0894; E04F 13/08; E04F 13/0801; E04F 13/0889; E04B 2/08; E04B 1/6145; E04B 1/12; E04B 1/6133; E04B 1/6116
USPC ..... 52/582.1, 586.1, 586.2
See application file for complete search history.

(56) References Cited

U.S. PATENT DOCUMENTS 213,740 A * 4/1879 Conner ..... B61D 17/24 52/553
2,863,185 A * 12/1958 Riedi ..... E04B 1/6154 29/523
4,599,841 A * 7/1986 Haid ..... E04F 15/02016 52/396.04

(Continued)

FOREIGN PATENT DOCUMENTS

CN 118327381 A * 7/2024 ..... E04B 1/642
CN 118547794 A * 8/2024 ..... E04C 5/16

(Continued)

*Primary Examiner* — Beth A Stephan
(74) *Attorney, Agent, or Firm* — Patshegen IP; Moshe Pinchas

(57) ABSTRACT

The present invention relates to wall panels made of a cross laminated timber (CLT) and to such wall panel joints. Each side edge (5) of the wall panel (1) comprises a protrusion (51) extending thereof and a groove (52) adjacent to the protrusion (51). At the protrusion (51) a heel (53) is formed so that upon assembly of two adjacent wall panels (1) the heel (53) of one wall panel (1) is inserted into the groove (52) of another adjacent wall panel (1) and both assembled wall panels (1) form a wedge space (93) defined by the heels (53) and protrusions (51) of both assembled wall panels (1). The joint further comprises two wedges (30) where upon assembly of the two adjacent wall panels (1) both wedges (30) can be inserted into the wedge space (93) forming an interference fit between both wedges (30) and both wall panels (1).

8 Claims, 9 Drawing Sheets

(56) References Cited

U.S. PATENT DOCUMENTS

| | | | | |
|---|---|---|---|---|
| 6,617,009 | B1 * | 9/2003 | Chen | B29C 65/56 428/44 |
| 8,661,762 | B2 * | 3/2014 | Martensson | E04B 1/6129 52/592.2 |
| 8,806,832 | B2 * | 8/2014 | Kell | E04G 23/0285 52/592.4 |
| 2004/0182036 | A1 * | 9/2004 | Sjoberg | E04F 15/02 52/592.1 |
| 2005/0016107 | A1 * | 1/2005 | Rosenthal | B32B 27/04 52/578 |
| 2007/0028547 | A1 * | 2/2007 | Grafenauer | F16B 5/002 52/586.1 |
| 2011/0078977 | A1 * | 4/2011 | Martensson | E04B 1/6141 52/745.13 |
| 2015/0176289 | A1 * | 6/2015 | Hannig | E04F 15/02038 52/582.2 |
| 2016/0002913 | A1 * | 1/2016 | Schilcher | E04B 1/61 52/586.2 |
| 2021/0095479 | A1 * | 4/2021 | Schneider | E04F 13/0898 |
| 2022/0220728 | A1 * | 7/2022 | Morrow | E04C 2/205 |
| 2025/0223792 | A1 * | 7/2025 | McGilton | E04B 1/12 |

FOREIGN PATENT DOCUMENTS

| | | | | |
|---|---|---|---|---|
| JP | 2013019219 | A * | 1/2013 | |
| WO | WO-2013060871 | A1 * | 5/2013 | E04C 2/40 |
| WO | WO-2019038268 | A1 * | 2/2019 | F16B 5/0012 |

* cited by examiner

JOINT FOR WALL PANELS MADE OF CROSS LAMINATED TIMBER

FIELD OF THE INVENTION

The present invention relates to wall panel joints, especially to the wall panels made of a cross laminated timber (CLT).

BACKGROUND OF THE INVENTION

The prior art discloses various wall panel joints. One of such wall panel joints is disclosed in the Chinese utility model registration No. CN211229019 describing the wall comprising a wall body and a wall surface, a groove, which is dug in the right end of the wall body, a left wood plate, arranged on the left side of the interior of the wall surface, connecting blocks, riveted to the upper side and the lower side of the right end of the left wood plate, right wood plates, riveted to the right ends of the connecting blocks, and a hollow layer, formed between the left wood plate and the right wood plates. The following solution uses rivets as joint elements. US patent application publication No. 2021/0095479 discloses a Cross-Laminated Timber (CLT) used to connect two CLT components such as CLT panels. The CLT joint includes a first CLT component and a second CLT component. The first CLT component includes a recessed channel. The second CLT component includes a grooved extension. The grooved extension and the recessed channel have complimentary patterns. The grooved extension is configured to nest within the recessed channel. The CLT panel includes a first CLT side and a second CLT side. The first CLT side includes a recessed channel. The second CLT side may be opposite the first CLT side and includes a grooved extension.

European patent publication No. EP1929103 discloses a joint for panels having a first edge and a second edge, the first edge being provided with a distal edge and a downwards protruding heel. The distal edge is further provided with an upper joint edge beneath which a groove is arranged. The second edge is provided with lower cheek having a distal end at which an upwards protruding lower cheek heel is arranged. The second edge is further provided with an upper joining edge beneath which an undercut is arranged. A moveable locking element is arranged in the space created by the undercut. The moveable locking element have a locking tongue, a locking tongue leg and a manoeuvring leg. International application publication No. WO2019/038268 discloses a construction system for walls, slabs and supporting elements, in which a first construction element has a joint surface provided with a tongue, and a second construction element has a joint surface provided with a groove. The tongue can be inserted into the groove with play, when the two construction elements are assembled to form a joint at said joint surfaces. The system further comprises a spline inserted between a first side surface of the tongue and a first side surface of the groove, so as to push the joint surface of said first construction element, in the direction of the height of the tongue, against said joint surface of said second construction element. International application publication No. WO2013/060871 discloses a foam blade that is connectable to a blade of the same type by a tongue and groove system in which the blade includes two major opposite surfaces and four edges connecting said surfaces, a first and a second opposite parallel edge each having a section forming a tongue type profile and a groove type profile, each one of said first and second edges having a recess over the entire length of the tongue type profile thereof, the opening of the recess being oriented toward the median plane between the tongue and the respective groove, the shape of the second edge being complementary to the shape of the second edge except at the recesses, and the position of each one of the recesses being such that said recesses are suitable for forming together a cavity during the connections of two blades of the same type.

Japanese patent application publication No. JP2006183377A discloses a connection structure of wooden building where the wood panels are joint together by the wedge. Similar structure is described in the Japanese patent application publication No. JP2013019219A.

Aim of the invention is to design an easy to manufacture and assemble wall panel structure.

SUMMARY OF THE INVENTION

The aim is reached by a design of a wall panel joint comprising two wall panels interconnected to each other by means of locking features at the edges of said wall panels and by means of wedges, particularly a set of two wedges. The wall panels are made of CLT. CLT panel is a wood panel product made from gluing together layers of solid-sawn lumber, i.e., lumber cut from a single log. Each layer of boards is oriented generally perpendicular to adjacent layers and glued on the wide faces of each board, usually in a symmetric way so that the outer layers have the same orientation. An odd number of layers or configurations with even numbers may be used. Regular timber is an anisotropic material, meaning that the physical properties change depending on the direction at which the force is applied. By gluing layers of wood at right angles, the panel is able to achieve better structural rigidity in both directions. It is similar to plywood but with distinctively thicker laminations or lamellae. CLT wall panels may comprise three to seven layers, preferably five layers.

The wall panel is elongated, rectangular wall panel. The wall panel has a front face and a back face, spaced apart from the front face, two side edges, where each side edge extends between the front face and the back face on each respective side of the faces, and a top edge and a bottom edge. The front face and the back face are the widest faces compared to the side edges and the top and the bottom edge. The bottom edge is the edge, on which the wall panel is supported, for example, on the base of the building to be made. The top edge is the edge, on which the roof or ceiling may be supported.

Each side edge of the first wall panel comprises a protrusion extending thereof. As the first wall panel comprises two side edges, the protrusions are also two—each for one side edge. The protrusion extends from the side edge of the wall panel so that one of the faces of the one protrusion is on the same level as the surface of the front face and one of the faces of the another protrusion is on the same level as the surface of the back face. Each side edge of the panel comprises a groove adjacent to the protrusion. The protrusion as well as the groove are formed along entire side edge of the wall panel. At the end or tip of the protrusion a heel is formed. The heel extends from the protrusion generally orthogonal forming a hook-like feature. In one embodiment of the invention, the heel comprises a lip extending from said heel and in the direction away from the side edge of the wall panel. The heel is formed along entire protrusion of the wall panel and the lip is formed along entire heel of the wall panel.

Upon assembly of two adjacent wall panels the heel or the heel with the lip on one wall panel are inserted into the groove of the adjacent wall panel and both assembled wall panels form a wedge space defined by the heels and protrusions of both assembled first wall panels. The two wedges are inserted into the wedge space so that the interference fit is formed between both wedges and both first wall panels securing thereof. In other words, two wedges are inserted into the wedge space in such a tightly fit manner with the part of the heels and the part of the protrusions of both assembled wall panels that no empty space is left. Aforementioned features allow to assemble wall panels without lifting any of said wall panel. No lifting of one of the wall panels in necessary, which considerably decreases a complexity of assembly. Hence, dangerous and work consuming lifting operations are avoided.

Each wedge is in the form of elongated bar and one side edge of the wedge is inclined so that upon assembly of the first wall panel with the second wall panel both wedges can be inserted into the wedge space, in result of which an interference fit is formed between the both wedges and both wall panels. The wedge has a first end with a first end cross section and a second end with a second end cross section. The first end cross section of the wedge is smaller than the second end cross section of the same wedge, in result of which one side edge of the wedge is inclined in relation to opposed side edge, wherein all other edges are straight. Upon insertion of the wedges into the wedge space both wedges are opposed to each other with its inclined edges. The wedge comprises four side edges and two ends—a first end and a second end. The cross section of the second end of the wedge is in the form of a square and the cross section of the first end of the same wedge is in the form of a rectangle. The longest side of the rectangle of the cross section of the first end of the wedge is equal to the one side of the square of the cross section of the second end of the same wedge. The shortest side of the rectangle of the first end cross section of the first end is one third from the one side of the square of the cross section of the second end of the same wedge.

The wall panels and wedges are processed to obtain certain moisture content. The moisture content of the first wall panel and the second wall panel is in the range of 10% to 16%, preferably 12%. The moisture content of the wedge (30) is in the range of 5% to 9%, preferably 7%.

BRIEF DESCRIPTION OF THE DRAWINGS

The drawings illustrate generally, by way of example, but not by way of limitation, various embodiments of the invention.

DETAILED DESCRIPTION OF THE EMBODIMENTS

Figure 1:
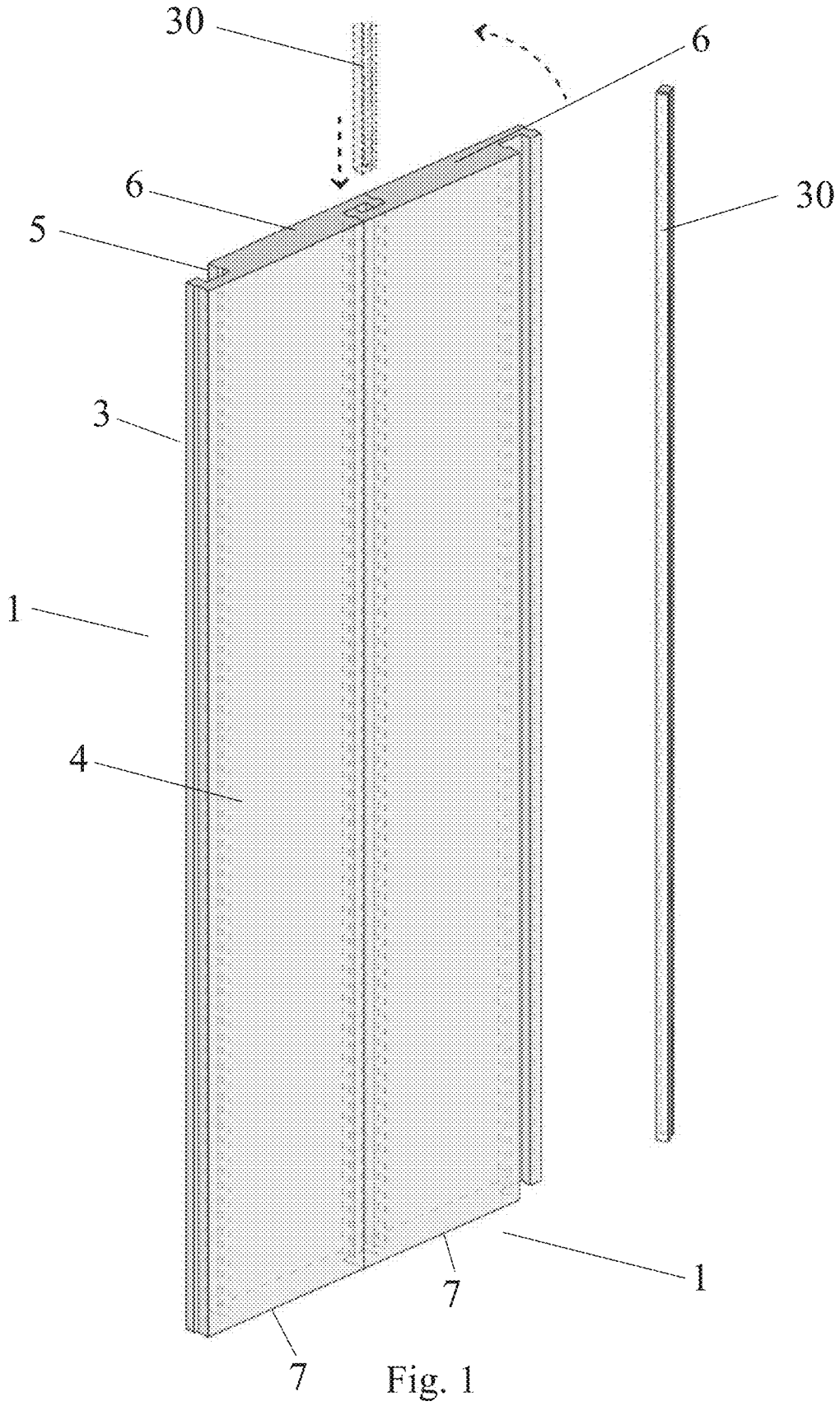
FIG. 1 is a perspective view of a wall panel joint comprising two joined wall panels (1) and a set of two wedges (30) ready to be inserted in a wedge space (93).
Figure 2:
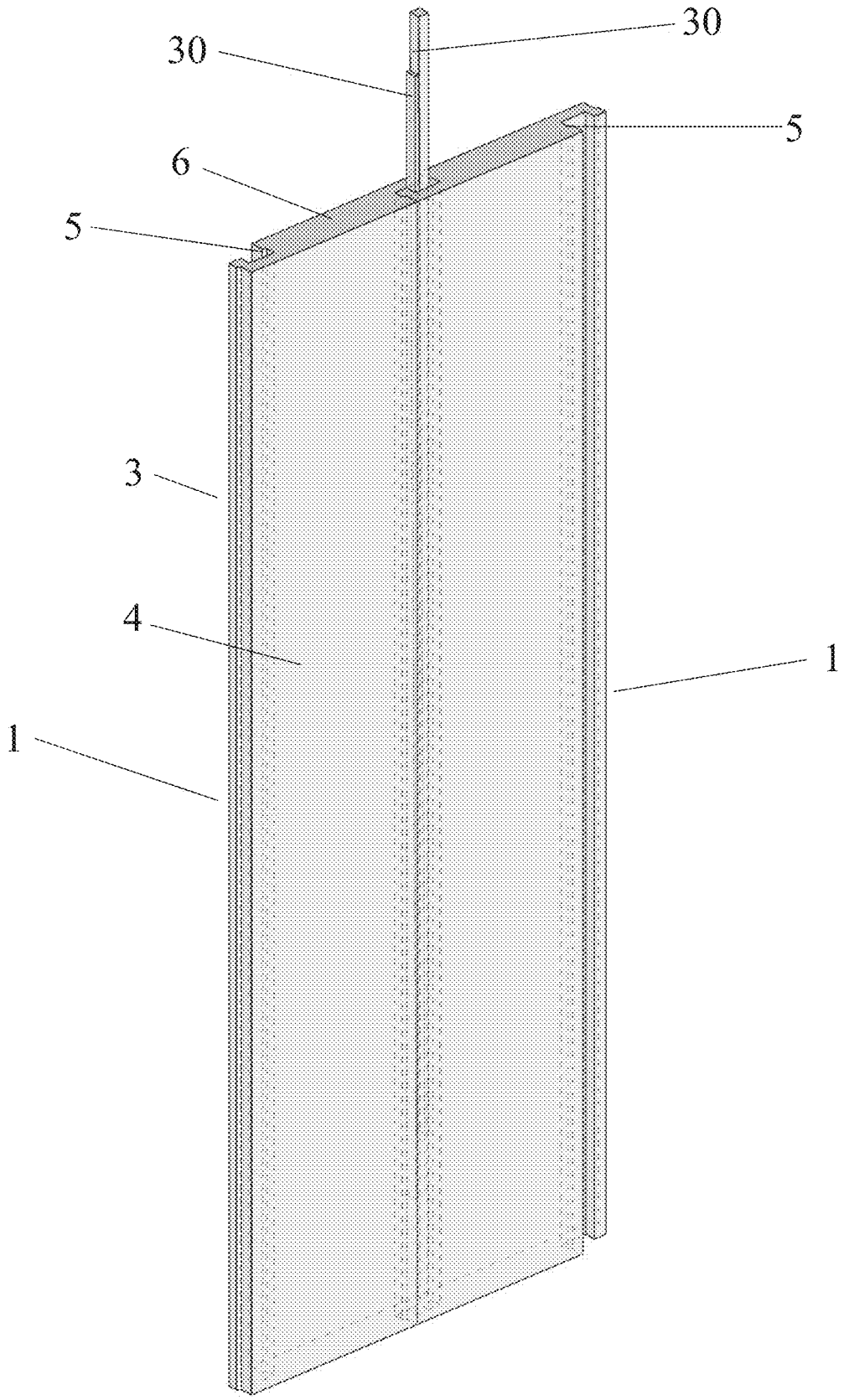
FIG. 2 is a perspective view of the wall panel joint as seen in FIG. 1 where the set of two wedges (30) is partly inserted into the wedge space (93).
Figure 3:
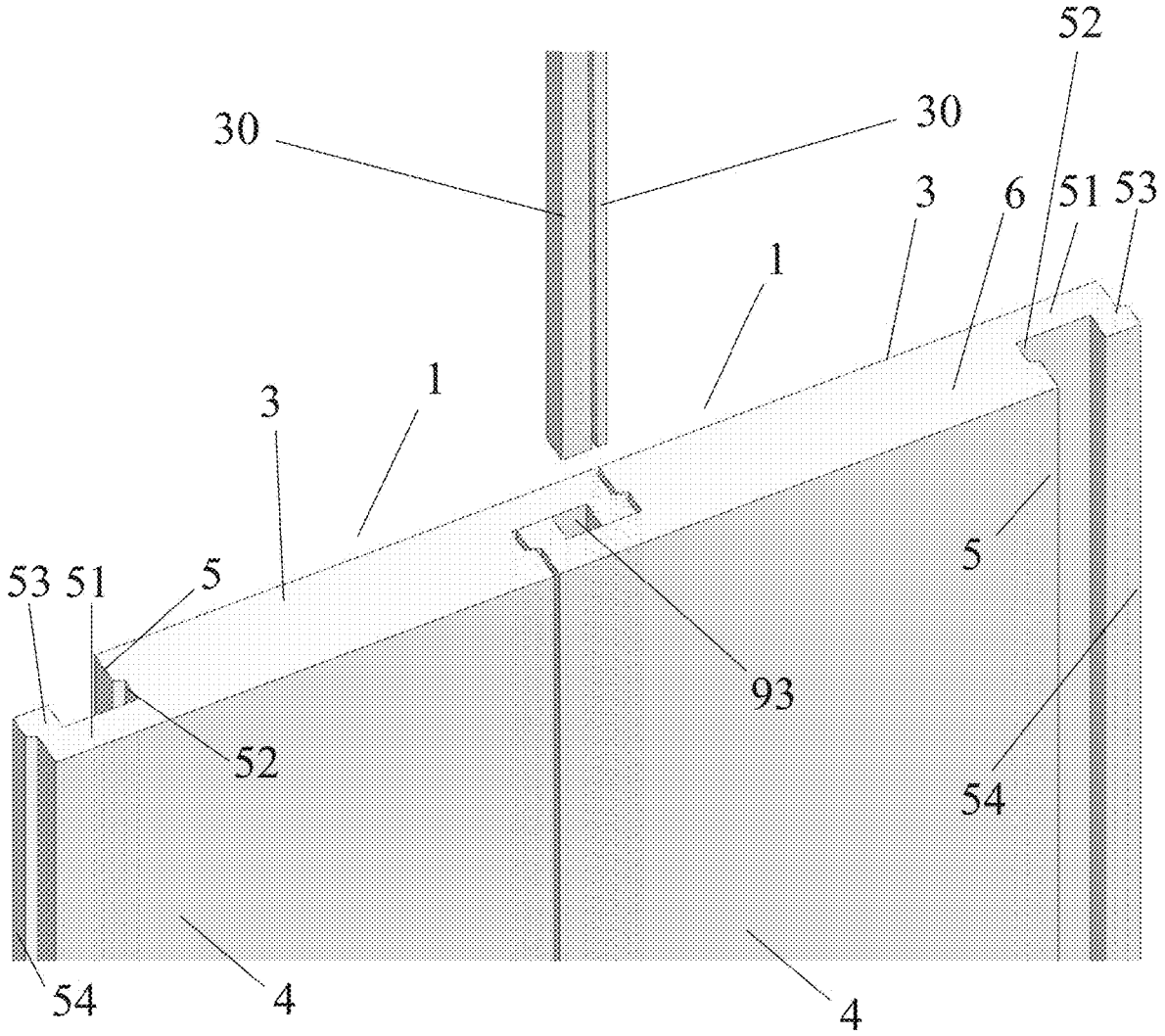
FIG. 3 is a perspective upper view of a wall panel joint wherein both wall panels (1) are almost joined and a set of two wedges (30) is ready to be inserted into a wedge space (93).
Figure 4:
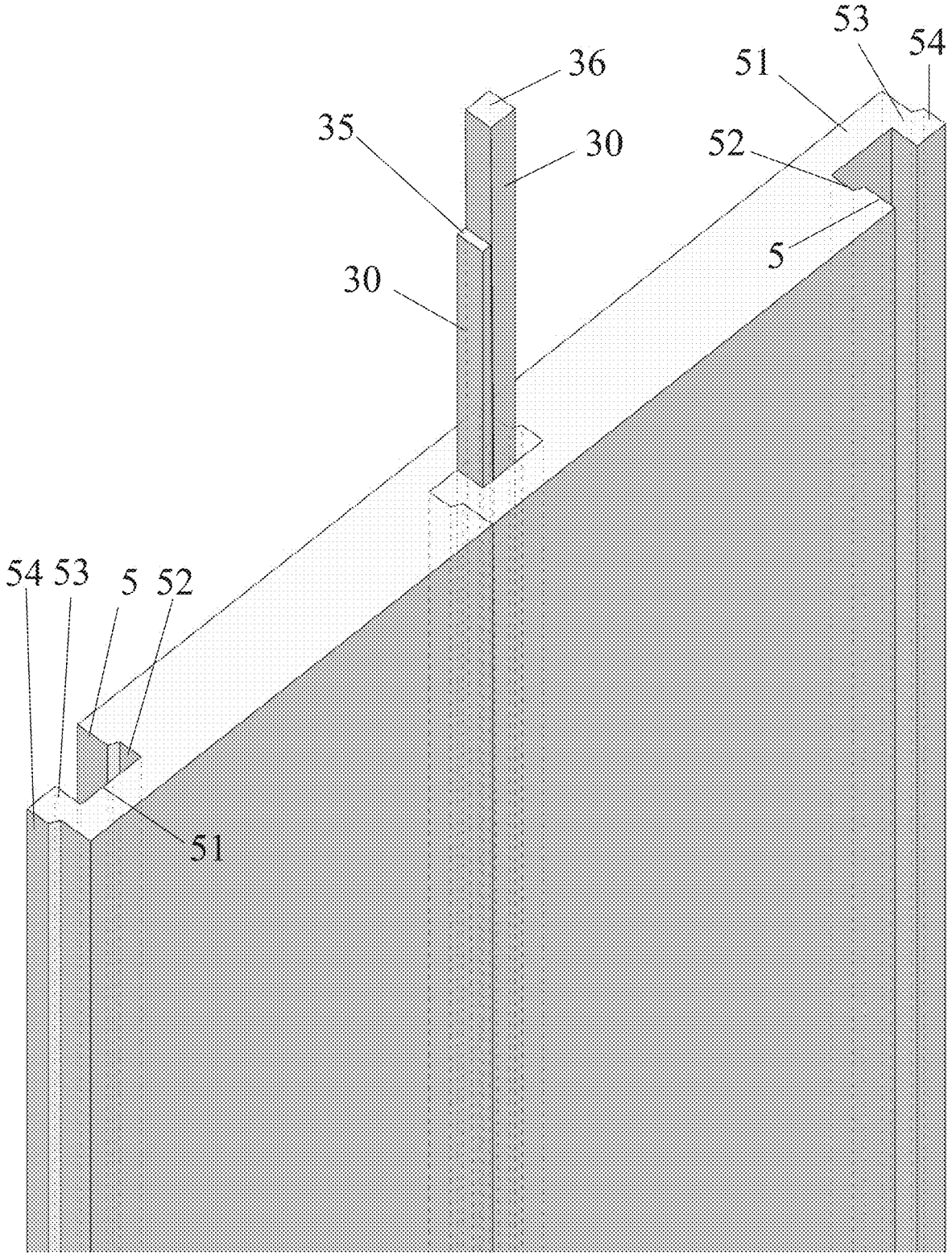
FIG. 4 is a perspective upper view of the wall panel joint wherein both wall panels (1) are joined and a set of two wedges (30) is partly inserted into a wedge space (93).

The preferred embodiments of the invention are now described with reference to the figures to illustrate objectives, advantages, and efficiency of the present invention.

FIGS. 1 to 4 illustrates a wall panel joint comprising two wall panels (1) joint together by their joint features and a set of two wedges (30). Each wall panel (1) having a front face (3) and a back face (4), spaced apart from the front face (3), two side edges (5), where each side edge (5) extends between the front face (3) and the back face (4) on each respective side of the faces (3; 4), and a top edge (6) and a bottom edge (7). The joint features of the wall panel (1) are the following. Each side edge (5) of the wall panel (1) comprises a protrusion (51) extending thereof and a groove (52) adjacent to the protrusion (51). At the end of the protrusion (51) a heel (53) is formed so that upon assembly of two adjacent wall panels (1) the heel (53) of one wall panel (1) is inserted into the groove (52) of another adjacent wall panel (1) and both assembled wall panels (1) form a wedge space (93) defined by the heels (53) and protrusions (51) of both assembled wall panels (1). The wall panel joint further comprises a set of two wedges (30) insertable into the wedge space (93). In order to provide durability and sustainability of the wall panel joint the moisture content of the first wall panel (1) is 12% and the moisture content of the wedge (30) is 7%.

Each wedge (30) is in the form of elongated bar and one side edge (31) of the wedge (30) is inclined and the inclined one side edges (31) of both wedges (30) are opposed to each other so that upon assembly of the two adjacent wall panels (1) both wedges (30) can be inserted into the wedge space (93) forming an interference fit between both wedges (30) and both wall panels (1). The wedge (30) having a first end (35) with a first end cross section and a second end (36) with a second end cross section, wherein the first end cross section is smaller than the second end cross section, in result of which one side edge (31) of the wedge (3) is inclined in relation to opposed side edge (32). the second end cross section of the second end (36) of the wedge (30) is in the form of a square and the first end cross section of the first end (35) of the same wedge (30) is in the form of a rectangle, wherein the longest side of the rectangle of the first end cross section of the first end (35) of the wedge (30) is equal to the one side of the square of the second end cross section of the second end (36) of the same wedge (30), and wherein the shortest side of the rectangle of the first end cross section of the first end (35) is one third from the one side of the square of the second end cross section of the second end (36) of the same wedge (30). Two wedges (30) inserted into the wedge space (93) are so tightly fit with the part of the heels (53) and part of the protrusions (51) of both assembled wall panels (1) that no empty space is left. (see FIGS. 5, 6, 8 and 9).

Figure 5:
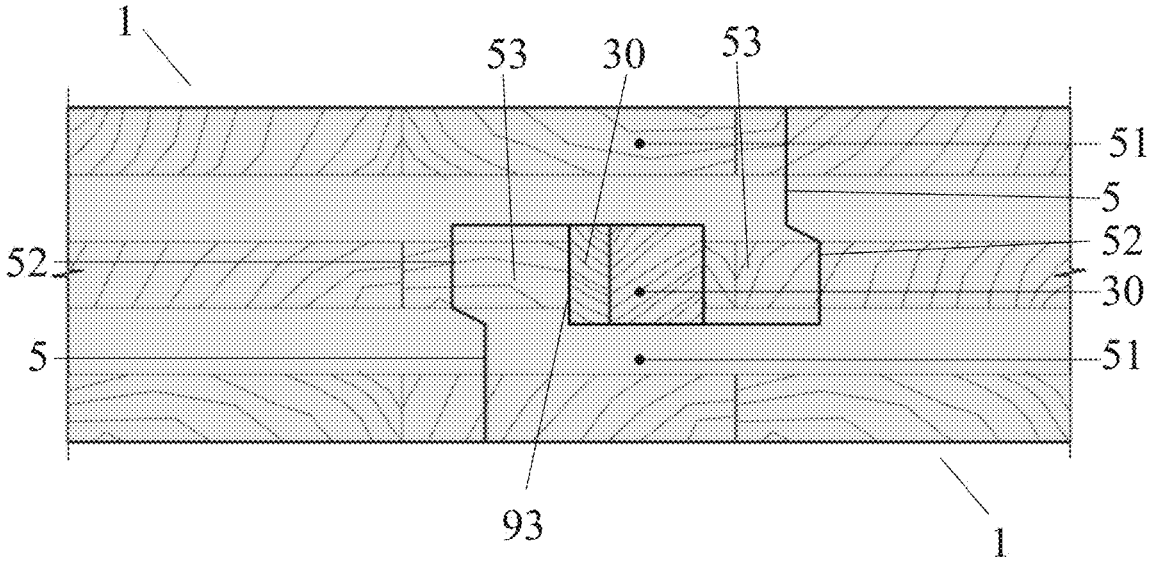
FIG. 5 is a cross sectional view of a wall panel joint comprising two wall panels (1) and a set of two wedges (30) inserted in a wedge space (93) with an interference fit.
Figure 6:
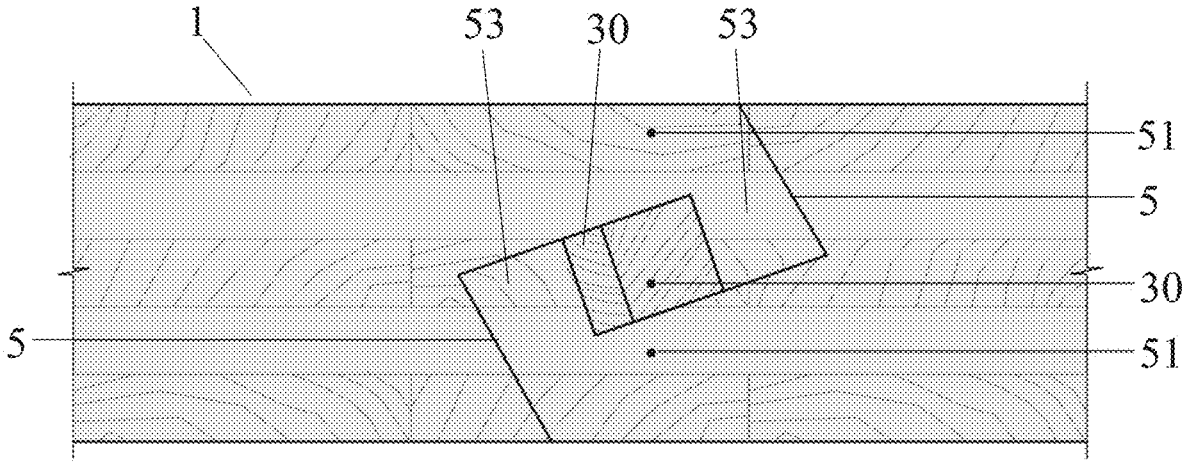
FIG. 6 is a cross sectional view of another embodiment of a wall panel joint comprising two wall panels (1) and a set of two wedges (30) inserted in a wedge space (93) with an interference fit.

The wall panel (1) itself is made of cross laminated timber (CLT) in five layers as seen in FIGS. 5 and 6.

Figure 7:
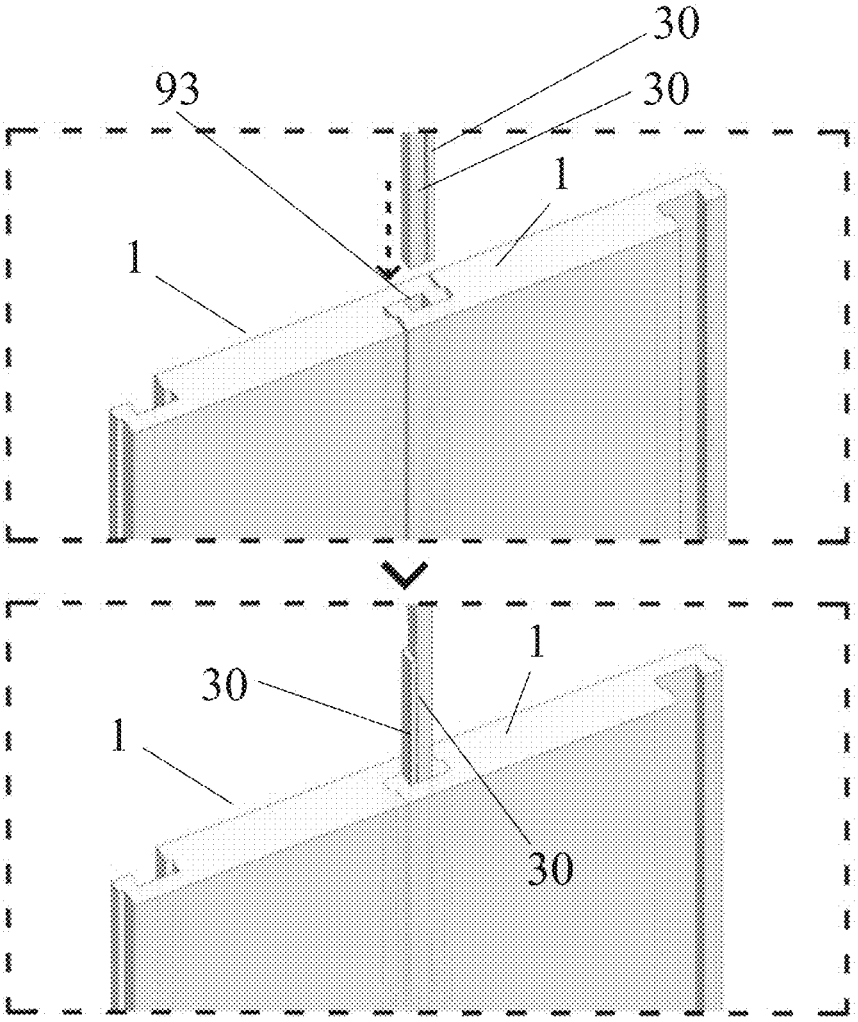
FIG. 7 illustrates assembly of a wall panel joint.
Figure 8:
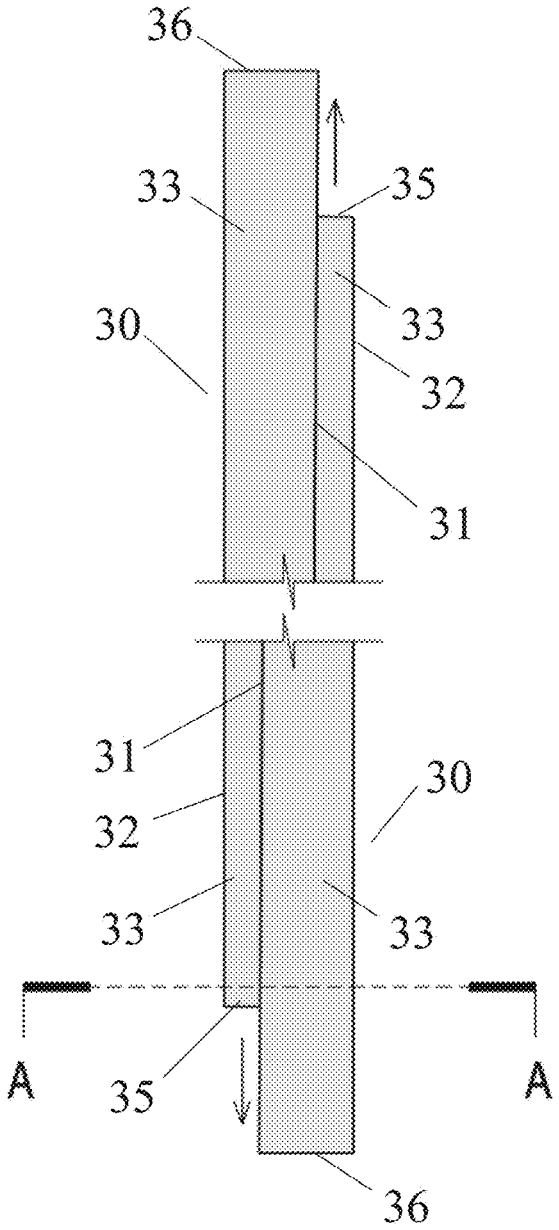
FIG. 8 is a side view of a set of wedges (30).
Figure 9:
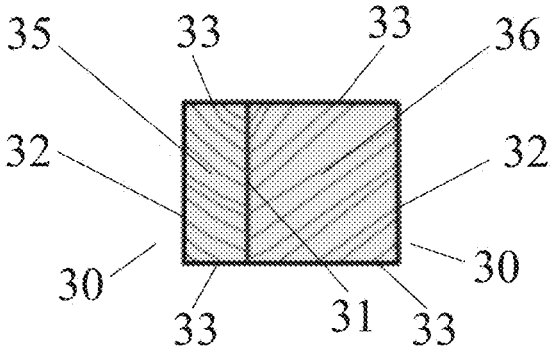
FIG. 9 is a cross sectional view of a set of wedges (30) as seen in FIG. 8 A-A.

FIG. 7 illustrates assembly process of the wall panels (1). First, the panels are arranged next to each other and moved together with their edges so the wedge space (93) is formed. The wall panels (1) are brought together without any need to lift any of the panels (1). The next and the last step is insertion of the set of two wedges (30) into the wedge space (93). The length of the wedge (30) is the same as the length of the wall panel (1) so that the wedges (30) can be fully inserted into the wedge space (93). After the insertion of the set of two wedges (30) the assembly process of the wall panels (1) is complete. This two-step assembly process allows rapid construction of building of any configuration.

In one embodiment of the invention (see FIGS. 1 to 5, and 7), the heel (53) of the wall panel (1) comprises a lip (54) extending from the heel (53) and away in relation to the side edge (5) of the wall panel (1) so that upon assembly of both wall panels the lip (54) of one wall panel (1) is positioned in the groove (52) of another adjacent wall panel (1).

Figure 10:
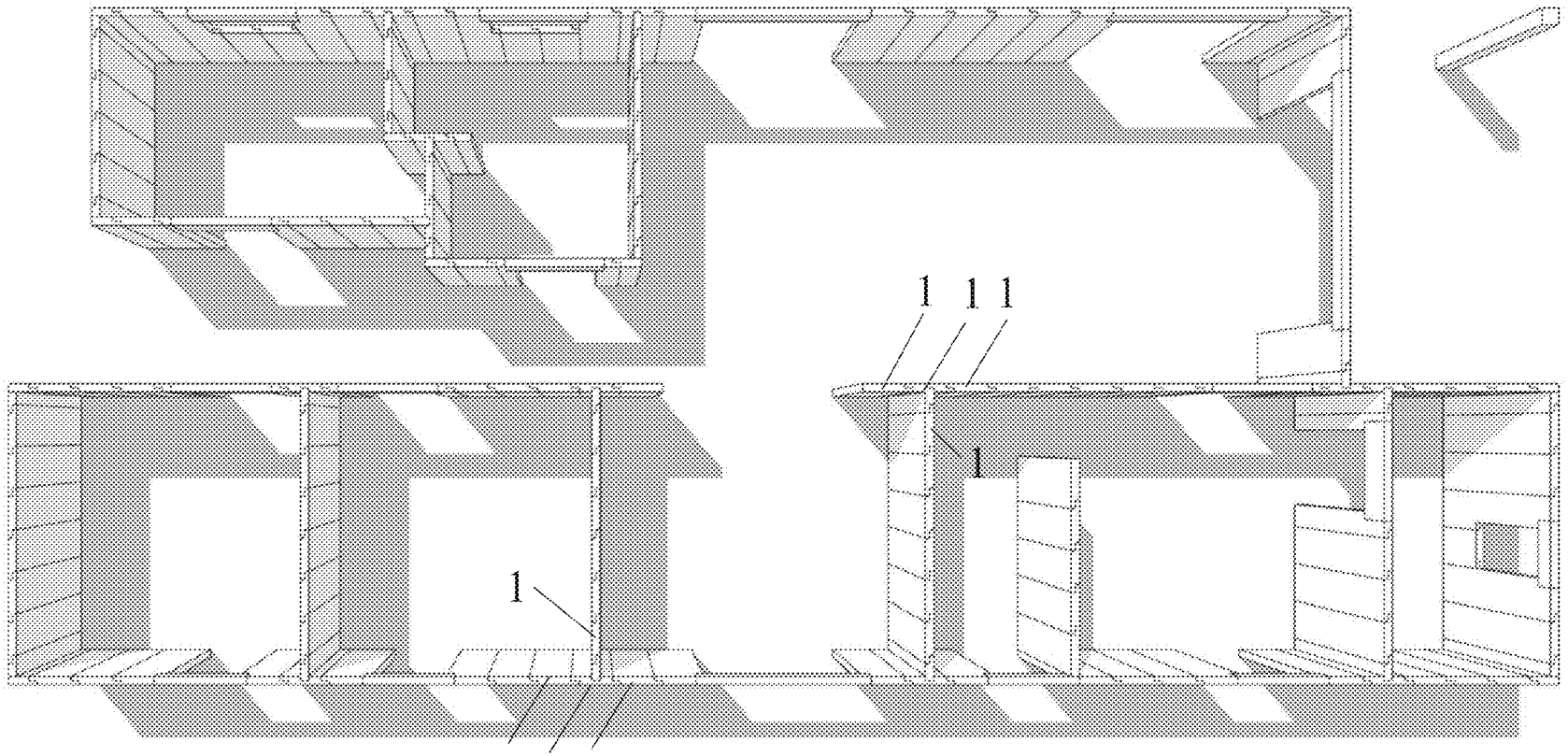
FIG. 10 is a perspective upper view of a building assembled from the wall panels (1).
Figure 11:
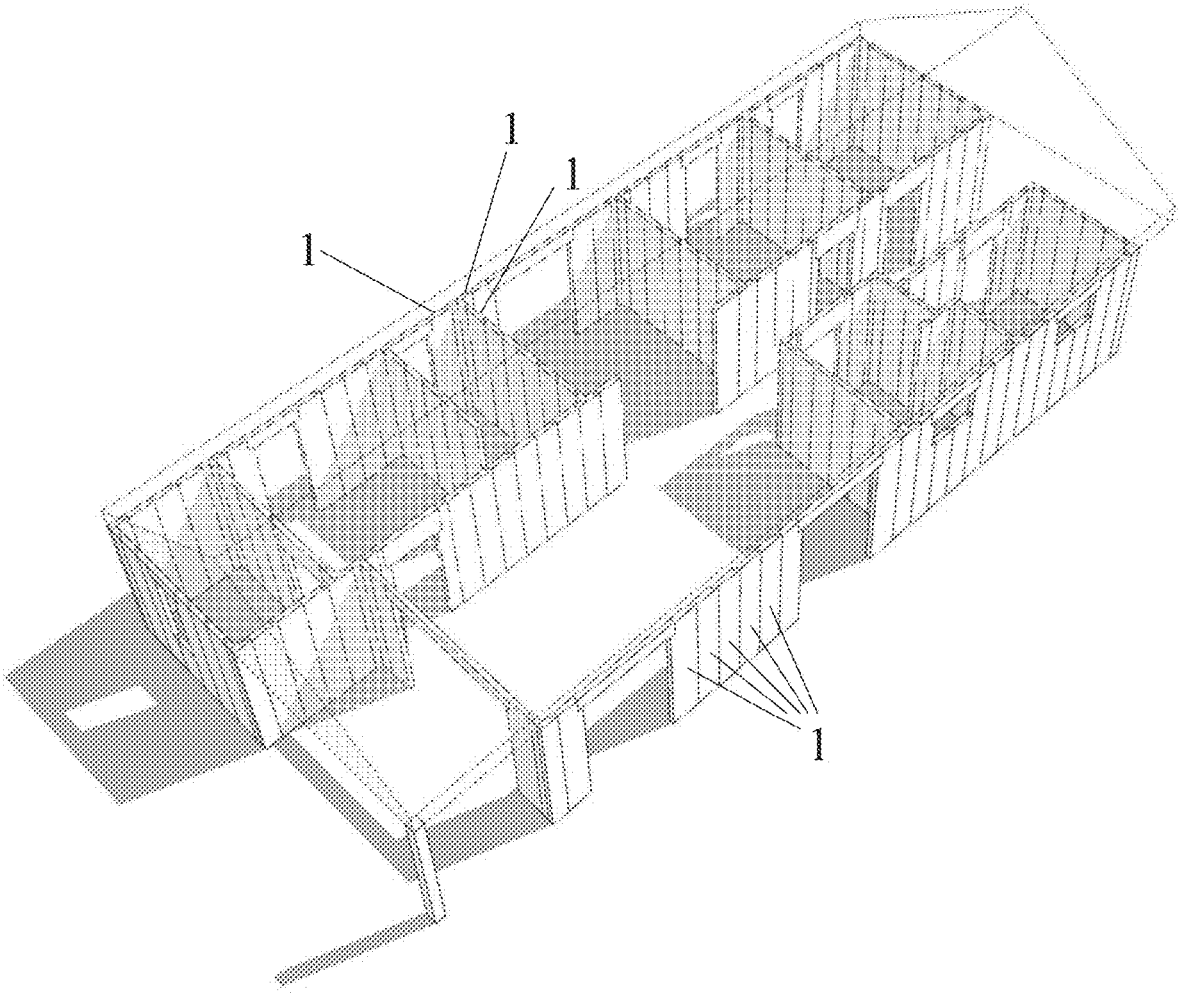
FIG. 11 is another perspective upper view of a building assembled from the wall panels (1) as seen in FIG. 10.

FIGS. 10 and 11 illustrates one embodiment of the invention, wherein walls of the building are made using aforementioned wall panels (1). Ease of assemble the wall panels (1) allow to considerably shorten assembly process as well as allow to assemble the wall without a use of cranes or any other lifting mechanisms.

While the invention may be susceptible to various modifications and alternative forms, specific embodiments of which have been shown by way of example in the figures and have been described in detail herein, it should be understood that the invention is not intended to be limited to the particular forms disclosed. Rather, the invention includes all modifications, equivalents, and alternatives falling within the scope of the invention as defined by the following claims.

LIST OF REFERENCES

1—a first wall panel;
3—a front face of a first wall panel;
4—a back face of a first wall panel;
5—side edge of a first wall panel;
6—a top edge of a first wall panel;
7—a bottom edge of a first wall panel;
30—a wedge;
31—an inclined side edge of a wedge;
32—a side edge opposed to an inclined side edge of a wedge;
33—a side edge of a wedge;
35—a first end of a wedge;
36—a second end of the wedge;
39—a wedge space between joined first wall panel and a second wall panel;
51—a protrusion;
52—a groove;
53—a heel;
54—a lip; and
93—a wedge space between the two joined first wall panels.

The invention claimed is:

1. A wall panel joint assembly comprising:

at least two adjacent wall panels with a joint therebetween when the panels are connected to one another, each of the wall panels comprises a front face and a back face, spaced apart from the front face (3), two side edges (5), where each of the side edges extends between the front face and the back face on each respective side of the faces, and a top edge (6) and a bottom edge (7);

wherein each of the side edges comprises a protrusion extending therefrom and a groove adjacent to the protrusion, wherein at the end of the protrusion a heel is formed so that upon interconnection of the two adjacent wall panels the heel of one of the wall panels is inserted into the groove of the adjacent wall panel and the interconnected wall panels form a wedge space therebetween defined by the heels and protrusions of the interconnected wall panels, wherein the wall panel joint assembly further comprises a set of two wedges, wherein each of the wedges is an elongated bar and comprises opposite wedge side edges, one of the wedge side edges is inclined with respect to the other of the wedge side edges, the inclined edges of the wedges are opposed to each other and configured to be inserted into the wedge space forming an interference fit between the wedges and the wall panels; and wherein each of the wall panels is made of cross laminated timber (CLT).

2. The wall panel joint according to claim 1, wherein each of the wedges has a first end with a first end cross section and a second end with a second end cross section, wherein the first end cross section is smaller than the second end cross section, such that the wedge side edges are inclined with respect to one another.

3. The wall panel joint according to claim 1, wherein the second end cross section is a square and the first end cross section is a rectangle, wherein the length of the longest side of the rectangle of the first end cross section is equal to the length of one side of the square of the second end cross section, and the length of the shortest side of the rectangle of the first end cross section has a length one third the length of the side of the square of the second end cross section.

4. The wall panel joint according to claim 1, wherein each of the wall panels comprises three to seven layers, preferably five layers.

5. The wall panel joint according to claim 1, wherein the moisture content of one of the wall panels is in the range of 10% to 16%, preferably 12%.

6. The wall panel joint according to claim 1, wherein the moisture content of the wedges is in the range of 5% to 9%, preferably 7%.

7. The wall panel joint according to claim 1, wherein the two wedges inserted into the wedge space are fit with the heels and the protrusions of the assembled wall panels such that there is no gap between the heels and protrusions.

8. The wall panel joint according to claim 1, wherein the heel of the wall panel comprises a lip extending from the heel and away from the side edge of the wall panel so that upon assembly of the wall panels the lip of one of the wall panels is positioned in the groove of the adjacent wall panel.

* * * * *